United States Patent [19]

Messina

[11] 4,175,743

[45] Nov. 27, 1979

[54] ELECTRONIC GAME

[76] Inventor: Gene Messina, 12 Buccaneer La., East Setauket, N.Y. 11733

[21] Appl. No.: 861,847

[22] Filed: Dec. 19, 1977

[51] Int. Cl.[2] ..... A63F 9/14

[52] U.S. Cl. ..... 273/1 E; 35/22 R

[58] Field of Search ..... 273/1 E; 35/11 R, 22 R

[56] References Cited

U.S. PATENT DOCUMENTS

| | | | |
|---|---|---|---|
| 2,265,598 | 12/1941 | Firestone et al. | 273/1 E |
| 2,943,855 | 7/1960 | Jauna et al. | 273/1 E |
| 3,029,526 | 4/1962 | Olalainty | 35/22 R |
| 3,208,747 | 9/1965 | Kavakos | 273/1 E |
| 3,943,629 | 3/1976 | Veno et al. | 273/1 E X |

FOREIGN PATENT DOCUMENTS

| | | | |
|---|---|---|---|
| 649908 | 10/1962 | Canada | 273/1 E |
| 1180737 | 2/1970 | United Kingdom | 273/1 E |

*Primary Examiner*—Paul E. Shapiro

*Attorney, Agent, or Firm*—Kevin Redmond

[57] ABSTRACT

A maze formed of two conductors, bracketing the maze path, is traversed by a conductive wand controlled by the operator. The path may be viewed by means of a mirror to increase the skill required to operate the game.

2 Claims, 2 Drawing Figures

ELECTRONIC GAME

BACKGROUND

1. Field

This invention pertains to electronic games and more particularly electronic games involving a maze.

2. Prior Art

A number of games include an electronic maze, an alarm or a display, such as the games described in U.S. Pat. Nos. 3,913,909, 3,645,529, 3,488,053, 2,943,855 and 2,808,263. However, once skill has been gained with a particular maze, the challange is lost and interest wanes with continued use. Although a more difficult maze would make the game more interesting for an experienced player, it would tend to cause the beginner to lose interest because of early and possibly repeated failure. There is no simple way in any of the above mentioned patents to accommodate the novice and experienced player, nor is there any means to increase the difficulty of the game to provide for continued interest.

SUMMARY

The present invention is a game essentially comprising a maze path or track of two conductors, a conductive wand, a mirror for viewing the maze and a counter for indicating the number of times the wand tip touches the conductor. The player draws the wand along within the maze path and the counter records the number of errors occurring when the player touches either of the conductors with the wand tip. A variety of environmental layouts with cutouts corresponding to the maze path may be placed over the path to increase the interest. For beginners, the game is played by viewing the maze path directly. For more experienced players, the game is made more difficult by requiring the players to observe the track indirectly by means of the mirror.

An object of the invention is to provide portable amusement.

A second object is to develop skill in precise eye-hand coordination where a device controlled by hand may be viewed directly or indirectly by way of a mirror.

A third object is to test the ability to concentrate while carrying out visually controlled motor tasks under stress created by task time limits and alarms, such as a buzzer or flashing light, which are actuated when an error in control occurs.

A fourth object is to provide a means for improving and measuring manual dexterity for the therapeutic and diagnostic purposes as in the treatment and test of motor skills requiring varying degrees of fine manipulation.

A fifth object is to detect learning disabilities, such as those evidenced by difficulty with the concept of reverse images or impaired eye and hand coordination.

DETAILED DESCRIPTION OF THE INVENTION

Figure 1:
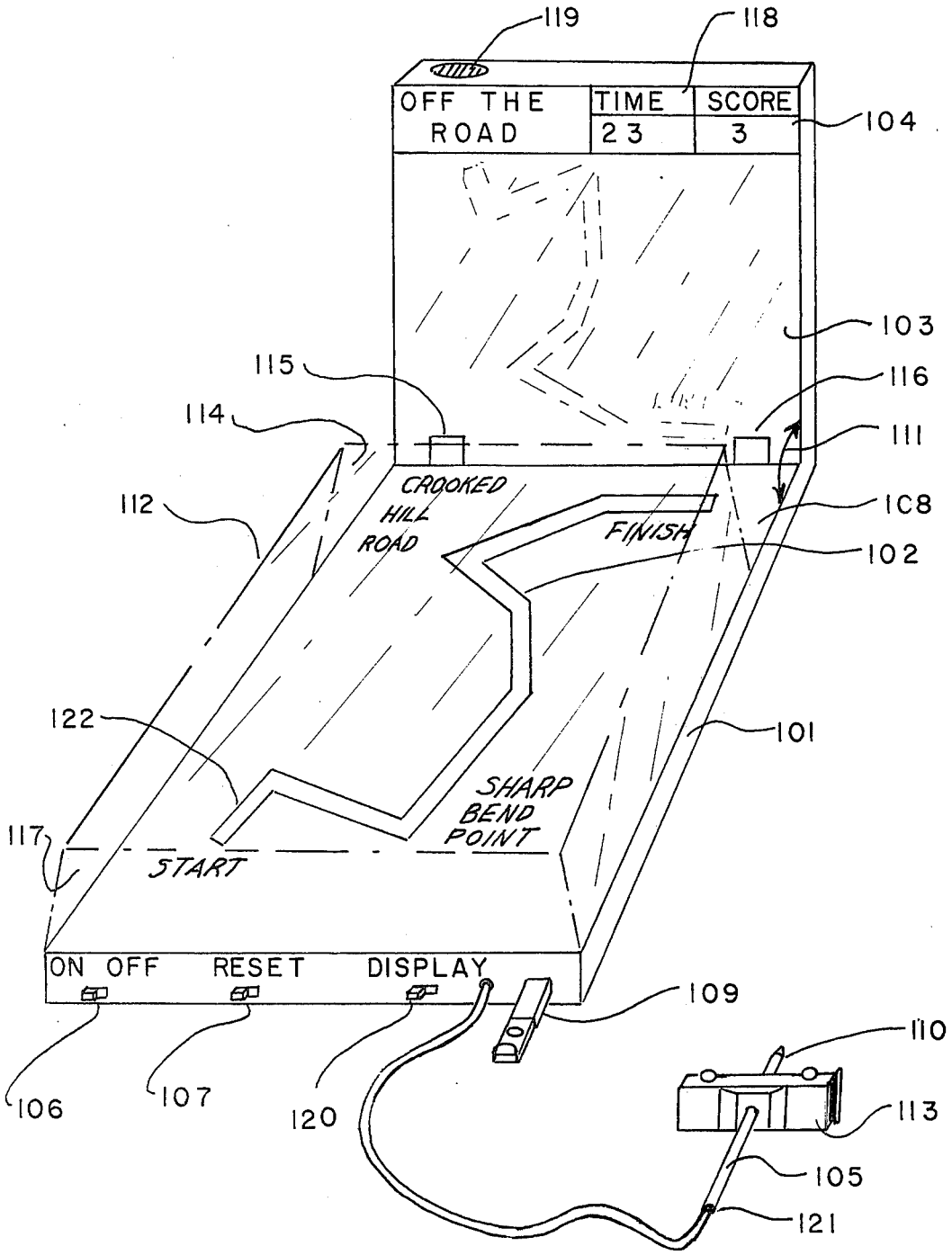
FIG. 1 is a pictorial view of the game.

Referring to FIG. 1, the game 101 comprises a maze path 102 made of two closely spaced parallel conductive lines, an environmental layout board 108 with a cutout 122 which corresponds to the shape of the maze path, a wand 105 with a handle 121, a tip 110 and a model 113, a reflective surface 103 oriented at an angle 111 with respect to the layout board to present an indirect view of the board to the player, a cover 112 for the layout board with an opening at one end 117 for use by the player, and another opening 114 at the opposite end to provide for indirect viewing of the board by way of the reflecting surface or mirror 103, a polarized light source 115, a nonpolarized light source 116, a counter and counter display 104, a timer and timer indicator 118, an audible and visual alarm 119, an on-off switch 106, a coin insertion device 109, and a display alarm selection switch 120.

In preparing the game, a particular environmental layout board and corresponding model are chosen, such as a roadway through the countryside and a sports car. For the beginner, the cover 112, if opaque, is removed for direct observation of the maze path. The environmental layout board is then set in place over the maze path. The on-off switch is placed in the "on" position or alternatively, where coin operation is desired, a coin is placed in the coin acceptance device and inserted to actuate the on-off switch and supply power to maze, wand, and displays.

In the operation of the game, the player traverses the maze path with the wand tip held between the conductors. The wand tip is nominally one-sixteenth of an inch in diameter while the maze conductors are closely spaced at nominally three-eighths of an inch, leaving a clearance on either side of the wand tip of only five-thirty seconds of an inch. With such close spacings, the player must exercise care and concentration in order to traverse the maze without contacting either maze conductor. Failure to do so will cause the displays to indicate an error.

A different indication of the error is presented, depending on the particular display which is chosen by positioning the selector switch. In the counter position, each error will be counted and displayed as digits on the counter display. In the audible and visual alarm position, a buzzer will sound and a light will flash each time an error is made.

Many variations of the basic game, which remain within the spirit and scope of the invention, are possible. For example, if a sports car is chosen as the model and country road is chosen for the layout board, the alarm may be a siren to simulate a police car siren and the flashing light may illuminate a sign warning "OFF THE ROAD", "YOU JUST RECEIVED A TICKET", or the like. If the layout board simulates a mine field, the model may be a tank and the alarm sound may simulate an explosion.

Other variations include changing the maze path and corresponding layout boards or varying the spacing between the wand and the maze conductors to vary the difficulty of the game.

The maze path conductors are changed by removing them from sockets provided at each end of the conductors. The spacing between the tip and conductors is changed in two ways. The conductors may be plugged into sockets which provide different spacing or wand tips of different thicknesses may be employed.

Games have been found to be interesting when they provide variety and a slight challange which can be met and overcome. Varying the layout, model, alarm and display provide one aspect of variety. Varying the conductor spacing provides another aspect of variety and allows adjustment of the challange to keep the game interesting as the players skill increases.

The greatest contribution in the present invention to both variety and challange is provided by the use of the cover and mirror. The mirror causes the player to view his actions in reverse and requires him to exhibit a high degree of coordination and skill, not generally found in other activities or games.

The game is shown in FIG. 1 with a translucent cover which is only one method contemplated to employ indirect viewing by way of the mirror. Several other variations of the cover may be employed. The simplest is an opaque cover which may be put in place or removed, as desired. The translucent cover may take several forms. The simplest of these includes an additional cover of flexible, opaque material, such as a vinyl sheet which is applied when indirect viewing is desired. In another variation of the translucent cover, the material may be made only partially translucent so that a bright light is required to illuminate the board for direct viewing. Switching to a low intensity light makes the cover essentially opaque; however, with the proper low intensity light, there will be sufficient illumination for indirect viewing by means of the mirror. Lights 115 and 116, shown in FIG. 1, may be used for the low and high intensity lamps.

Finally, the cover may be, in effect, a polarized filter. Light with the correct polarization from one source, such as light 116, will permit direct viewing while a source supplying cross polarized light, such as light 115, will make viewing possible only by means of the mirror.

To achieve the features described above, the game may be configured in a number of ways. A preferred embodiment is shown in FIG. 2.

Figure 2:
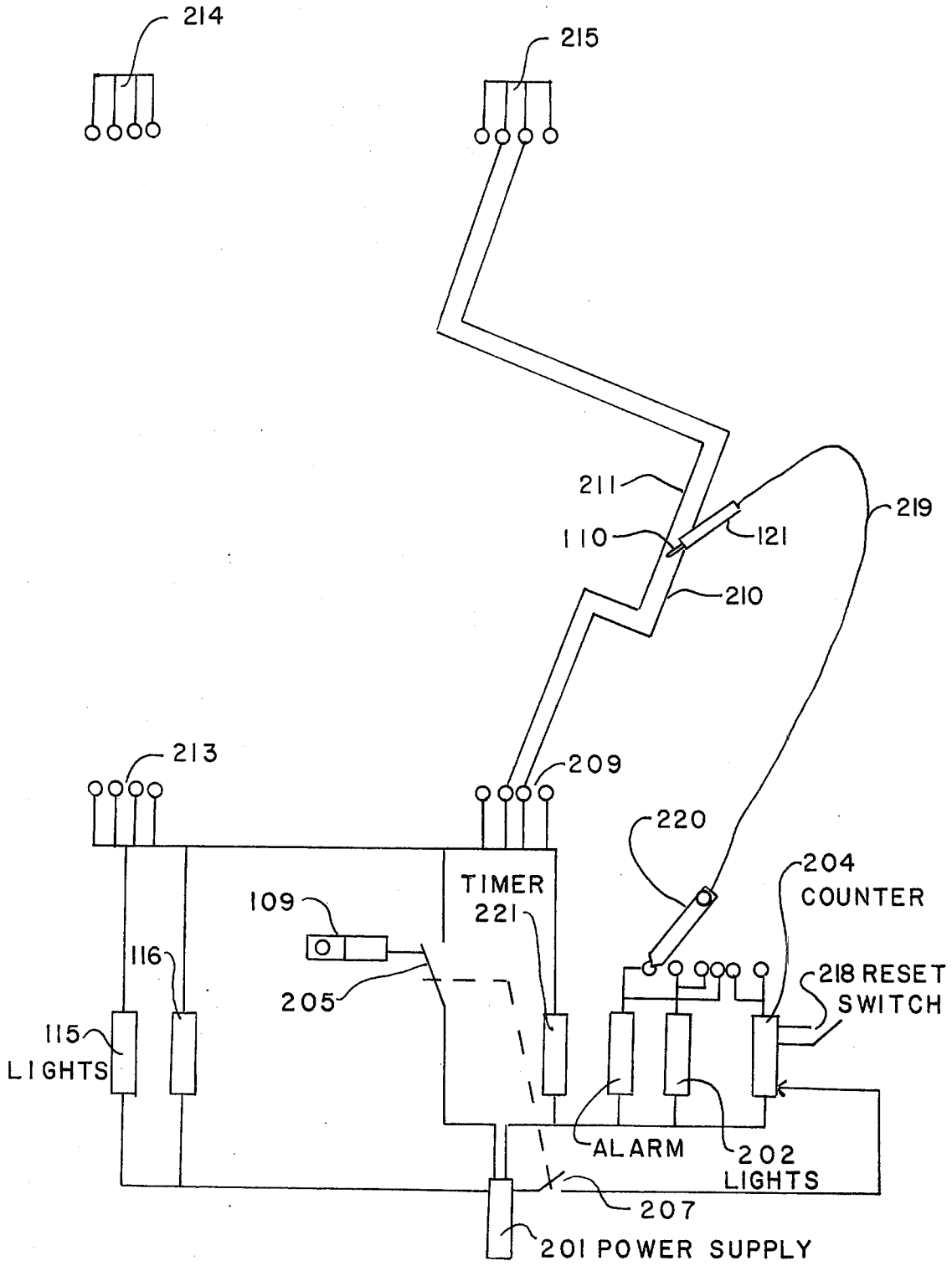
FIG. 2 is a schematic diagram of the game.

The embodiment in FIG. 2 comprises a power supply 201, a light 202, an alarm 203, a counter 204, an on-off switch 205, a coin insertion device 109 to control the on-off switch, a counter supply line 208, a counter supply switch 207, a first set of sockets 209 for the maze path conductors 210 and 211, a second, third and fourth set of sockets designated by drawing numerals 213, 214, and 215 respectively, a wand 121 with a wand tip 110, a wand conductor line 219, a display selector switch 220, a timer 221 and the lights 115 and 116.

In the operation of the system shown in FIG. 2, the on-off switch 205 is closed directly by hand or indirectly by means of the coin insertion device 109. The on-off switch is ganged to the counter supply switch so that the closing the on-off switch also closes the counter supply switch. It is also ganged to the timer so that after a predetermined time, the game is automatically turned off. Closing the on-off switch supplies power to the lights 115 and 116, the jacks 213 and 209. Jack 209, in turn, supplies power to the maze path conductors 211 and 210.

Whenever the wand tip touches either of the maze path conductors, power is supplied to the display selector switch 220 by way of the wand conductor line 219. Power from the selector switch is supplied to the alarm, light 202, or counter, depending on the position of the switch 220.

In this way each contact between the tip and the maze path conductors actuates either the light, alarm or counter or all three.

Having described the invention, I claim:

1. A game comprising:

(a) a pair of two generally parallel conductors shaped to form a track, (b) a wand having a handle for controlling the position of said wand by hand, and a conductive tip with a width less than the spacing between said conductors to pass said tip between said conductors without contacting them when the wand's position is carefully controlled by hand, (c) an indicator to indicate contact of the tip with either conductor, (d) means for electrically connecting said indicator to said track and to said tip to transmit a signal to said indicator when there is contact between the tip and track, (e) a reflective surface positioned for indirect viewing of said track, (f) means for controllably preventing direct viewing of the track by the operator, said means, for preventing direct viewing is a cover and said provision for controlling the wand beneath the cover includes a first opening in said cover for controlling said wand directly by hand, said cover is a polarized filter which passes light from a nonpolarized light source and blocks light from a cross polarized light source, (g) a cross polarized light source positioned to illuminate said track, (h) a nonpolarized light source positioned to illuminate said track, and (i) means for selectively activating each light, whereby the game may be viewed directly through the cover when the nonpolarized light source is activated, but can only be viewed indirectly by way of the reflective surface when only the polarized light is activated.

2. A game as claimed in claim 1, wherein said cover contains a nonpolarized portion to provide an unimpaired view of the track indirectly by way of said mirror.

* * * * *